United States Patent [19]

Graham

[11] 4,015,813

[45] Apr. 5, 1977

[54] BOOKHOLDER

[76] Inventor: Thomas Andrew Graham, 796 Maplewood Ave., Palo Alto, Calif. 94303

[22] Filed: Mar. 3, 1975

[21] Appl. No.: 554,809

Related U.S. Application Data

[63] Continuation-in-part of Ser. No. 477,622, June 10, 1974, abandoned.

[52] U.S. Cl. ..... 248/452; 248/460; 248/441 D

[51] Int. Cl.[2] ..... A47B 19/00

[58] Field of Search ..... 248/107, 441 D, 452, 248/453, 454, 455, 460; 281/45, 46, 47; 16/189

[56] References Cited

UNITED STATES PATENTS

| | | | |
|---|---|---|---|
| 115,886 | 6/1871 | North | 248/452 |
| 395,473 | 1/1889 | Bartley | 248/452 X |
| 399,411 | 3/1889 | Hyland | 248/452 X |
| 571,254 | 11/1896 | Whitmore | 248/453 |
| 884,722 | 4/1908 | Davis | 248/452 |
| 1,432,620 | 10/1922 | Radlein et al. | 248/452 |
| 2,648,513 | 8/1953 | Groff | 248/107 |
| 2,778,153 | 1/1957 | Raby | 248/452 |

FOREIGN PATENTS OR APPLICATIONS

| | | | |
|---|---|---|---|
| 1,500,548 | 9/1967 | France | 281/46 |

*Primary Examiner*—William H. Schultz
*Attorney, Agent, or Firm*—Flehr, Hohbach, Test, Albritton & Herbert

[57] ABSTRACT

A holder for both paperback and hardback books includes a spreader bar having finger-like page holders at each end thereof and a hairpin-like spine gripping member in the center. A stand member of wire-form construction is pivotally mounted on the spreader bar and is pivotable from a position placing the book upright, to a lower, inclined position wherein side arms of the stand serve as the support. In one form, friction hinges permit the book to be supported at different angles. The spine gripping member slides over the spine of the book while the page holders hold the pages in the open condition for reading.

8 Claims, 12 Drawing Figures

BOOKHOLDER

CROSS-REFERENCE TO RELATED APPLICATIONS

This application is a continution-in-part of my earlier co-pending application, Ser. No. 477,622, filed June 10, 1974 and now abandoned.

BACKGROUND OF THE INVENTION

This invention pertains to an improved bookholder for supporting and holding of the pages of the book in an opened condition, the apparatus being applicable to both paperback and hardback books.

SUMMARY OF THE INVENTION AND OBJECTS

In summary, the improved bookholder of the present invention includes a spreader member having page holder extensions at each end thereof disposed outwardly from socket-like members which form a hinge with the ends of a stand. A spine gripping member is mounted in the central portion of the spreader member and extends in the same direction as the page holders. The stand is pivotable with respect to the spreader member affording a plurality of support positions for the book and holder unit.

An object of the invention is to provide an improved bookholder which is flexibly adapted to accommodate books of various sizes and construction including paperback and hardcover books and which may be folded into a compact condition for carrying and which may be placed in several different positions for reading at different viewing angles.

In view of the above, it is another object to provide a multi-position, friction hinge in the bookholder of the type described.

Another object of the invention is to provide a compact bookholder which may be easily secured to and removed from the book, and which will not obstruct the reader in viewing the text, but will serve as a bookmark.

Another object of the invention is to provide an improved bookholder which becomes an integral part of the book, portable therewith and which may be folded around the book when not in use so that the holder and book as a unit may be stored in a briefcase or the like.

Another object of the invention is to provide an improved bookholder of relatively simple and efficient construction affording easy manufacture, use and long service life.

Further objects of the invention will appear from the detailed description thereof taken in connection with the accommodating drawings.

DESCRIPTION OF THE PREFERRED EMBODIMENTS

Figure 1:
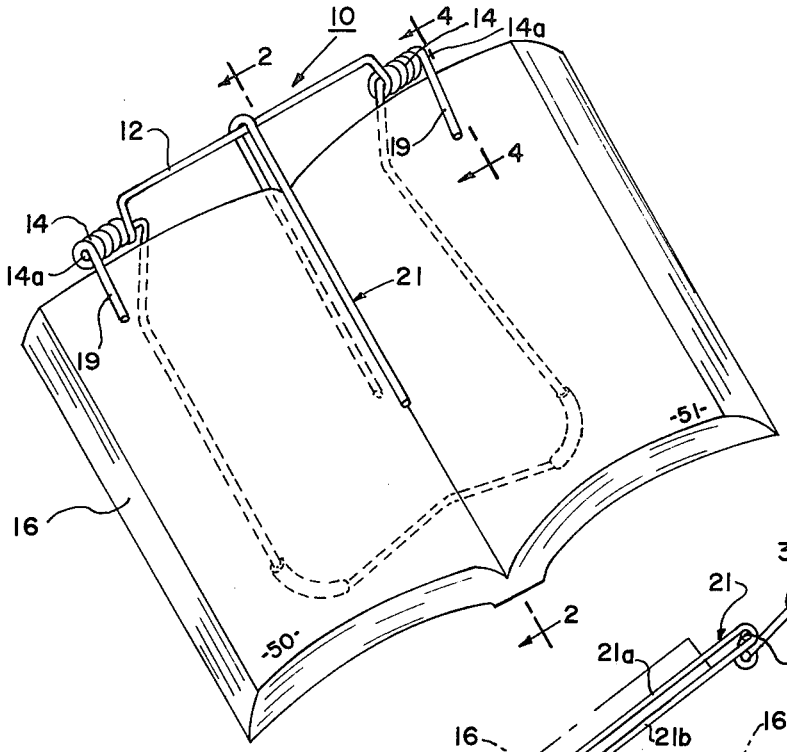
FIG. 1 is a perspective view of the bookholder of the present invention shown with a book held in an open position.
Figure 2:
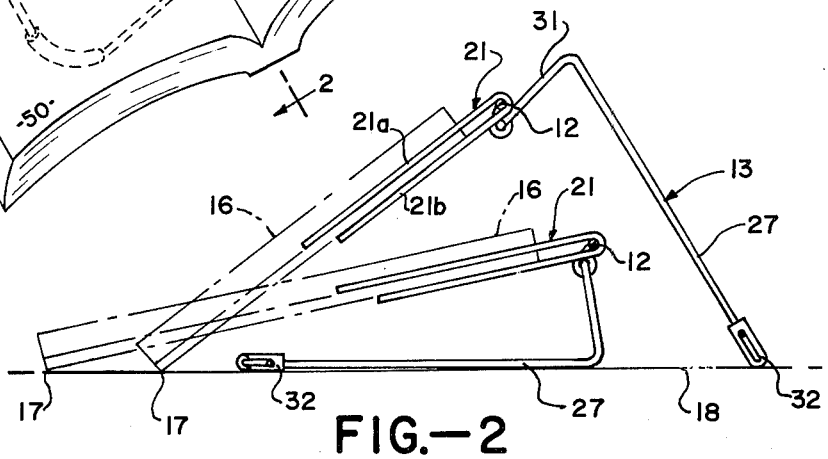
FIG. 2 is a sectional view along the lines 2—2 of FIG. 1, but showing the holder and book unit in two different positions for reading.

There is shown in FIG. 1 of the drawings a bookholder designated generally 10 and conforming to the principles of the present invention. The bookholder 10 includes a spreader bar member 12 and a stand 13, pivotally mounted together at hinges 14. A book 16 is shown mounted upon the bookholder 10 and being held open by the holder, the holder and book unit being disposed in the first or lower position for reading, such as on a desk. In FIG. 2 of the drawings, the bookholder 10 is shown in both the lower position and in a raised or erect position wherein the stand 13 and the lower end of the book 16 are supported from a support surface 18.

Figure 3:
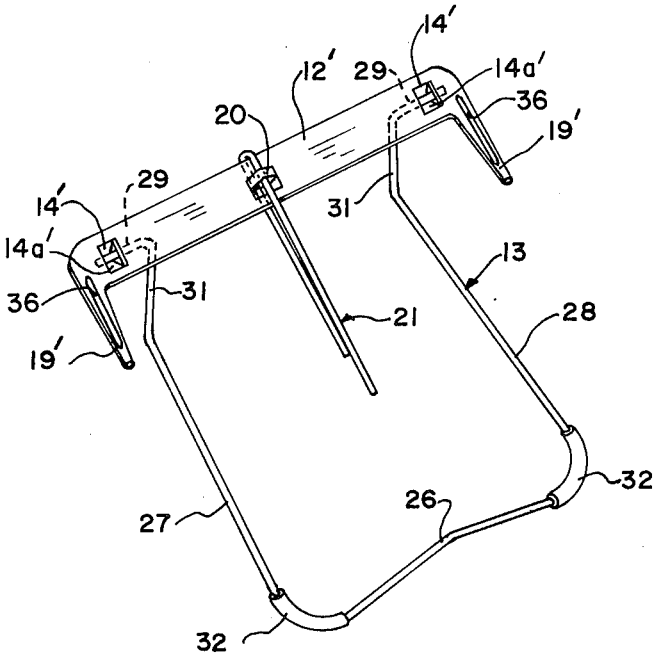
FIG. 3 is a perspective view of a modified form of the bookholder of the present invention.
Figure 4:
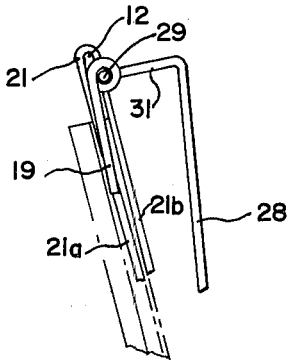
FIG. 4 is a detail view along the lines 4—4 of FIG. 1.

The spreader member 12 may be of wire-form construction as shown in FIGS. 1, 2 and 4 or may be of sheet metal construction as shown in FIG. 3. In either case, the spreader bar member includes at each of its ends a socket-like formation 14A to form the female portion of the hinge construction. In the embodiment shown in FIGS. 1, 2 and 4 this formation 14A is formed by coils of wire which are wound about an axis offset from the general axis of the spreader bar 12. The spreader bar includes at each end a page 19 which is formed integral with the spreader bar.

In the central portion of the spreader bar 12 there is secured, as by spot welding, a spine gripping member 21, resembling a large hairpin, and arranged to project in the same direction as the page holders 19. The spine gripping member 21 is of bifurcated construction and includes two tines 21A and 21b to be received on the inside and outside, respectively, of the book 16. As shown in FIGS. 1–3 the tine 21A is longer than tine 21B to facilitate installation of the gripping member on the book spine. In the relaxed condition of the bookholder the tines maybe biased towards each other. This bias serves to supply the gripping function on the book's spine, the spine generally being approximately of a thickness to place the tines in the parallel condition as illustrated in FIG. 2.

The central member 21 and the page holders 19 are preferably arranged in approximately the same plane.

The stand 13 comprises a foot portion 26 and two side arm members 27, 28 which are formed integrally with the foot portion 26 which is offset in the central position to prevent tilting or uneven surfaces. At the end of each side arm 27, 28 there is formed a pintle member 29 which cooperates with the socket-like formation 14 to furnish the hinge connection between the stand and the spreader member. The pintles 29 are formed at the ends of the side arm members being disposed in a plane approximately 90° to the arms 27, 28 and joined thereto by an intermediate portion 31 from which the pintles 29 project also at an angle of about 90°. The 90° angular disposition of the intermediate portion 31 with respect to the arms, as well as its length, permits a book of substantial thickness to be accommodated when the unit is in the lowered position as indicated in FIG. 4.

Referring to FIG. 3, another form of spreader member 12' is there shown as formed from sheet metal and having sockets 14A' formed from strikeouts from the general plane of the spreader so as to place the axis of the hinge 14' offset to one side of this plane. The page holders 19' are formed as integral extensions of the spreader member as shown and stiffening indentations 36 extend along the finger-like holders 19'. The spine gripping member 21 is mounted on the spreader as by insertion through two opposing centrally arranged strikeouts 20.

To prevent tearing or scratching of book pages, the ends of members 19, 19' and 21 may be finished off as by rounding or smoothing.

OPERATION

Figure 5:
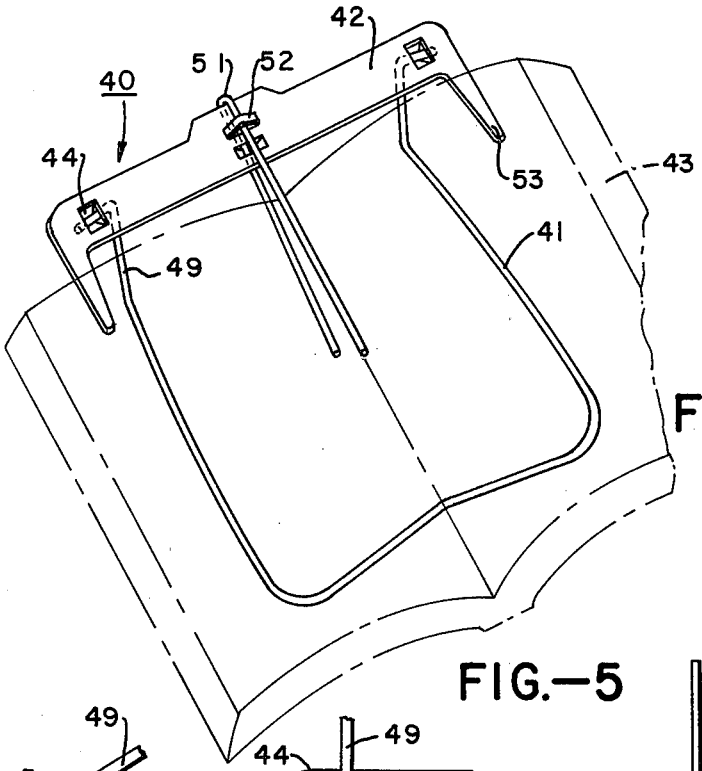
FIG. 5 is a perspective view of another preferred form of the present invention shown with a book held in the open condition.

In operation the bookholder is assembled simply by squeezing the side arm members 27, 28 together so that the pintles 29 will slide into the socket formation on the header bar. The pintles are slightly skewed so as to afford a stiff hinge joint. Thus, the stand and the spreader are pivotally mounted together. A book 16 is opened by bending back the pages and cover abruptly at several portions to relieve the tension built into the book during its fabrication. For example, the book may be opened to about page 50 and the spine gripping member slid between pages 50 and 51 to encompass and grip the spine or backing of the book as shown in FIGS. 2 and 5. The shorter one of the tines 21B will extend along the backing of the spine and the longer one 21A will extend into the inside of the spine as shown. Then pages 2 through 50 as a group are mounted under the right page holder if the book is then to be read beginning at page 1. After a page on the right is read, it is slid out from under the right page holder to be slid under the left page holder and there held.

The bookholder may be mounted in a flat or lower inclined position as shown in FIG. 2 wherein the side arms 27, 28 support the book from the surface 18. Alternatively, for a more upright position of the bookholder, the foot portion 26 and bottom edge of the book support the unit upwardly as shown in FIG. 2. Tubular anti-skid elements 32 may be arranged on the corner portions of the stand as shown in FIG. 3. In the upright position the stand at the intermediate portions 31 abuts the spreader 12, as shown in FIG. 2, arresting further rotation of the hinge. This permits the unit to function in an inverted position as when used by a person reading when flat on his back. When parked in an automobile, the stand may be slid over the steering wheel so that the book can be read with the hands free such as when having lunch in the automobile.

SECOND MODIFIED FORM OF BOOKHOLDER

Another modified form of a bookholder 40 is shown in the drawings, FIGS. 5–9. The bookholder 40 is distinguished from the bookholder forms described above in having relatively stiff, friction hinges created by built-in distortion permitting the stand 41 and spreader member 42 to be positioned in a variety of different positions so that a book 43 may be held, at many selected reading angles.

More particularly, the spreader member 42 is equipped with socket-like formations 44 which are fabricated by strikeouts from the general plane of the spreader member 42. The sockets 44 are spaced apart a distance less than the width of the foot 46 of the stand. Thus, when the pintles 47 are received in the sockets 44, the side arms 48 are slightly distorted or bowed as may be seen from FIG. 9.

Figure 6A:
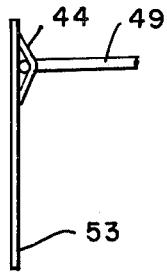
FIG. 6A is an end view of an improved friction hinge connection between the stand and spreader member and illustrating the position of the parts when the book is held in the condition shown in FIG. 5.
Figure 6B:
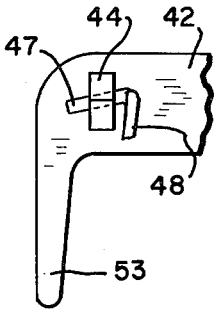
FIG. 6B is a partial plan view from the reverse side of the spreader member and corresponding to FIG. 6A.
Figure 7A:
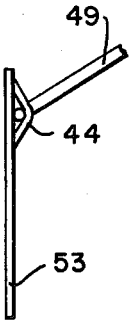
FIGS. 7A and 7B are similar respectively to FIGS. 6A and 6B with the exception that the hinge is shown holding the stand in an intermediate position with respect to the spreader member.
Figure 7B:
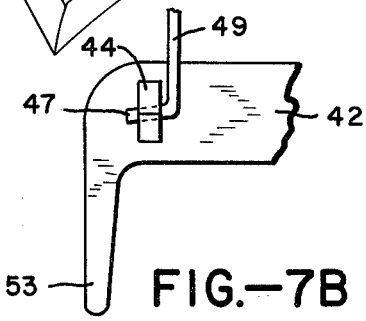
Figure 8A:
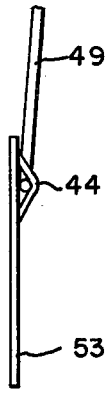
FIGS. 8A and 8B are similar respectively to FIGS. 6A and 6B with the exception that these figures illustrate the stand in the fully extended position with respect to the spreader member.
Figure 8B:
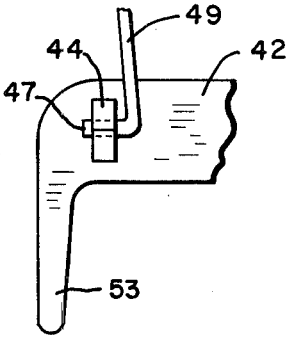
Figure 9:
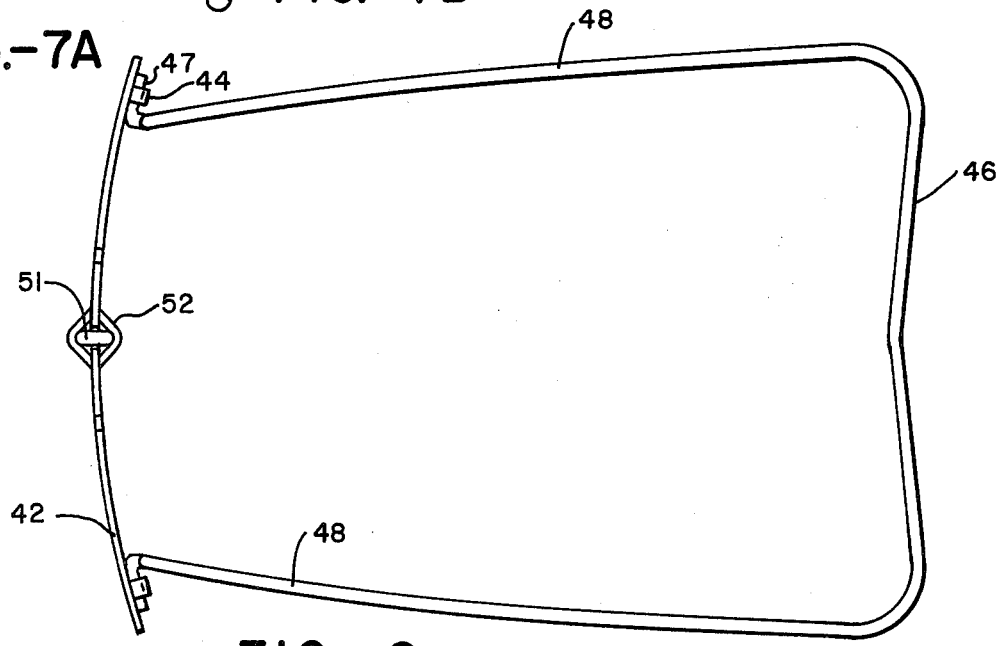
FIG. 9 is a view of the stand and the spreader member from the rear when the parts are in the fully extended position.

Referring to FIG. 6B, it may be seen that the pintle 47 is skewed at an angle of about 20 to 25 degrees with respect to the general axis of the socket 44, (highly consistant results have been achieved using an angle of 23° when the intermediate portion of the stand 49 is disposed at about a right angle to the spreader member. This angular disposition of the pintle 47 with respect to the strikeout socket 44 produces a desirable friction effect sufficient to hold the spreader member at several different positions with respect to the stand. For example, an intermediate position of the stand and spreader is illustrated in FIGS. 7A–7B, wherein the intermediate portion 49 extends at about 45° to the spreader member. As the fully extended position of the stand with respect to the spreader member is reached, as illustrated in FIGS. 8 and 9, the rotation of the skewed pintle member 47 within the strikeout socket 44 is such as to induce a bending distortion or bowing forces in the spreader member as the intermediate member 49 reaches an abutting condition with respect to the spreader.

A hairpin-like spine gripping member 51 is received within a spaced pair of strikeouts 52 centrally arranged on the spreader member as shown. The spacing of the strikeouts 52 affords substantial stiffness to the spreading of the gripping member when the book spine is received between the tines of the gripping member. Also the book will be snugly gripped.

A function provided by the skewed pintle and socket arrangement is that is permits the bookholder to be used by an invalid flat on his back in that the bookholder will function in the overhead position by reason of the friction, or stiff hinge disclosed.

The bookholder 40 includes on the spreader member 42 page holding members 53 and the unit 40 functions to hold the pages of a book in the selected condition in the manner described above in connection with the bookholder 10.

From the foregoing it will be seen there has been disclosed a bookholder of improved construction for retaining a book in the open condition and for supporting a book on various surfaces in a plurality of positions.

It is contemplated that the bookholder concept disclosed herein may be formed from plastic materials to achieve the advantages of the subject arrangement. More particularly, the spreader member lends itself to disign in plastic materials and the stand may as well be designed to achieve the advantages disclosed herein when formed from moldable plastic materials.

What is claimed is:

1. An improved bookholder for supporting a book and holding the pages thereof in the open condition for reading, comprising a spreader member adapted to extend along the top edge of the book when the same is in the open condition, said spreader member including at each end thereof a socket-like formation serving as portion of a hinge, a spine, a spine gripping member secured to said spreader intermediate the ends thereof and extending perpendicular thereto at one side of the spreader member, said gripping member being of bifurcated construction so as to define an openable slot therein for receiving the spine of the book in such slot, extension means at each end of said spreader member projecting in the same direction as said spine gripping member and serving to hold the pages of the book on each side of said gripping member in the selected open position, a stand of wire-form construction and including a foot portion having extending from the end portions thereof spaced side arms, the end portions of each side arm terminating in a pintle-like projection cooperatively received in an associated socket member of the spreader to effect a stiff friction hinge connection between the stand and spreader, the general axis of said hinge connection being offset from the general plane of said spreader member, said pintle member being skewed at an angle with respect to the general axis of the socket-like member of the spreader, and the end portions of said side arms serving as abutments with said spreader member when said bookholder is in an extended condition.

2. The bookholder of claim 1 wherein the width of the foot portion of the stand is substantially larger than the spacing between the socket-like formations on the spreader member, permitting the side arms of the stand to bow when the stand and spreader member are in the asssembled condition.

3. An improved bookholder for supporting a book and holding the pages thereof in the open condition for reading, comprising a spreader member adapted to extend along the top edge of the book when the same is in the open condition, said spreader member including at each end thereof a socket-like formation serving as a portion of a hinge, a spine gripping member secured to said spreader intermediate the ends thereof and extending perpendicular thereto at one side of the spreader member, said gripping member being of bifurcated construction so as to define an openable slot therein for receiving the spine of the book in such slot, extension means to each end of said spreader member projecting in the same direction as said spine gripping member and serving to hold the pages of the book on each side of said gripping member in the selected open position, a stand of wire-form construction and including a foot portion having extending from the end portions thereof spaced side arms, the end portions of each side arm terminating in a pintle-like projection cooperatively received in an associated socket member of the spreader to effect a hinge connection between the stand and spreader, the axis of said hinge connection being offset from the general plane of said spreader member and the end portions of said side arms serving as abutments with said spreader member when said bookholder is in an extended condition.

4. The bookholder of claim 3 wherein said spine gripping member comprises two wire-form tines resiliently biased together, the tines comprising a shorter tine for engaging the book on the outside of the spine, and a longer tine for engaging the book on the inside of the spine, said page holder members being substantially shorter in length than said spine gripping member.

5. The bookholder of claim 3 wherein said stand is pivotable with respect to said spreader member into a first position wherein said foot member is disposed close to the spine of the book and side arms can serve as a support for the book and holder with regard to a support surface, and further pivotable into a second position wherein said foot member is disposed away from the book and acts with the bottom edge portion of the book to support the book in an inclined, upstanding position.

6. The bookholder of claim 3 wherein the entire structure of said bookholder is of wire-form construction, the socket-like members being formed on the spreader bar by wire wound about itself to define a pivot axis.

7. The bookholder of claim 3 wherein said spreader member is formed of sheet material and said socket member is formed by strikeouts from the general plane of said spreader member.

8. The bookholder of claim 3 wherein said spreader member has a length of at least four inches and less than about seven inches so as to be substantially equivalent to the width of books to be accommodated by said bookholder.

* * * * *